US008881481B2

(12) United States Patent
Myers et al.

(10) Patent No.: US 8,881,481 B2
(45) Date of Patent: Nov. 11, 2014

(54) GRID FRAMEWORK ACCESSORIES

(75) Inventors: Jere W. Myers, Washington Boro, PA (US); Todd M. Bergman, Lititz, PA (US); Brian T. Patterson, Lewisberry, PA (US); Jae A. Eisenhower, West Chester, PA (US); Brett Sareyka, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 941 days.

(21) Appl. No.: 12/653,873

(22) Filed: Dec. 21, 2009

(65) Prior Publication Data

US 2010/0229475 A1 Sep. 16, 2010

Related U.S. Application Data

(60) Provisional application No. 61/139,252, filed on Dec. 19, 2008.

(51) Int. Cl.

| | |
|---|---|
| ***E04B 9/00*** | (2006.01) |
| ***H01R 25/16*** | (2006.01) |
| ***H01R 25/14*** | (2006.01) |
| ***E04B 9/06*** | (2006.01) |
| ***E04B 9/10*** | (2006.01) |

(52) U.S. Cl.

CPC ..... *H01R 25/14* (2013.01); *H01R 25/16* (2013.01); *E04B 9/006* (2013.01); *E04B 9/068* (2013.01); *E04B 9/10* (2013.01)

USPC ..... 52/506.08; 52/665; 52/712

(58) Field of Classification Search

CPC ..... E04B 9/006; E04B 9/242; E04B 9/26; E04B 9/24; E04B 9/28

USPC ..... 52/506.06–506.09, 712, 713, 665

See application file for complete search history.

(56) References Cited

U.S. PATENT DOCUMENTS

| | | | | |
|---|---|---|---|---|
| 3,089,570 | A * | 5/1963 | O'Neil, Jr. | 52/713 |
| 3,207,057 | A * | 9/1965 | Brown et al. | 454/301 |
| 3,521,332 | A | 7/1970 | Kramer | |
| 3,834,106 | A * | 9/1974 | Astedt et al. | 52/506.07 |
| 3,969,865 | A * | 7/1976 | Andersen | 52/506.07 |
| 4,088,293 | A * | 5/1978 | Delmore | 248/500 |
| 4,408,428 | A * | 10/1983 | Brooke et al. | 52/506.07 |
| 4,520,607 | A * | 6/1985 | Suckow | 52/489.1 |
| 4,560,126 | A * | 12/1985 | Judkins et al. | 248/72 |
| 4,671,811 | A * | 6/1987 | Cadwell et al. | 55/355 |
| 4,679,375 | A * | 7/1987 | Shirey | 52/777 |
| 4,873,809 | A * | 10/1989 | Paul | 52/506.07 |
| 5,369,928 | A | 12/1994 | Goodworth | |
| 6,029,414 | A * | 2/2000 | MacLeod | 52/506.07 |
| 6,386,495 | B1 * | 5/2002 | DeRaffele | 248/214 |
| 6,389,771 | B1 * | 5/2002 | Moller | 52/506.06 |

(Continued)

FOREIGN PATENT DOCUMENTS

| | | | | |
|---|---|---|---|---|
| DE | 3247506 | A1 * | 7/1984 | E04B 5/58 |
| WO | WO2009128909 | | 10/2009 | |

*Primary Examiner* — Elizabeth A Plummer

(74) *Attorney, Agent, or Firm* — Amy M. Fernandez

(57) ABSTRACT

The present invention is directed to accessories which are attached to the support grid members of a grid framework system. The accessories insulate electrified conductors attached to the support grid members from other conductive items located proximate thereto, a management device for cables and wires, and a retention device for fixedly attaching a component to the grid framework system.

19 Claims, 11 Drawing Sheets

(56) References Cited

U.S. PATENT DOCUMENTS

| | | | | |
|---|---|---|---|---|
| 6,729,587 | B1 | 5/2004 | White et al. | |
| 7,062,886 | B2 * | 6/2006 | Auriemma | 52/506.07 |
| 7,390,111 | B2 * | 6/2008 | Lippis | 362/396 |
| 7,552,567 | B2 * | 6/2009 | Ingratta et al. | 52/506.07 |
| 8,314,336 | B2 * | 11/2012 | Liang et al. | 174/68.1 |
| 2003/0021116 | A1 * | 1/2003 | Miller et al. | 362/249 |
| 2006/0272256 | A1 | 12/2006 | Frecska et al. | |
| 2007/0103824 | A1 | 5/2007 | Patterson et al. | |
| 2008/0086962 | A1 * | 4/2008 | Jahn et al. | 52/220.6 |
| 2008/0087464 | A1 | 4/2008 | Patterson et al. | |
| 2008/0148668 | A1 | 6/2008 | Jahn et al. | |
| 2010/0050561 | A1 * | 3/2010 | Jafari | 52/712 |

* cited by examiner

FIG. 17
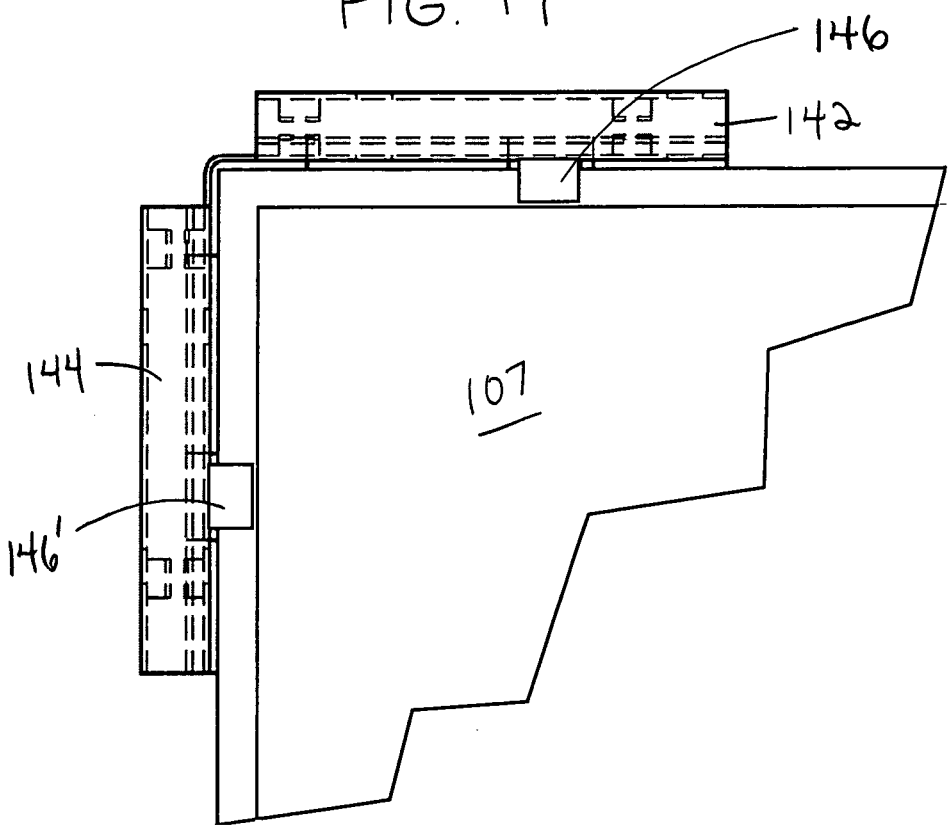
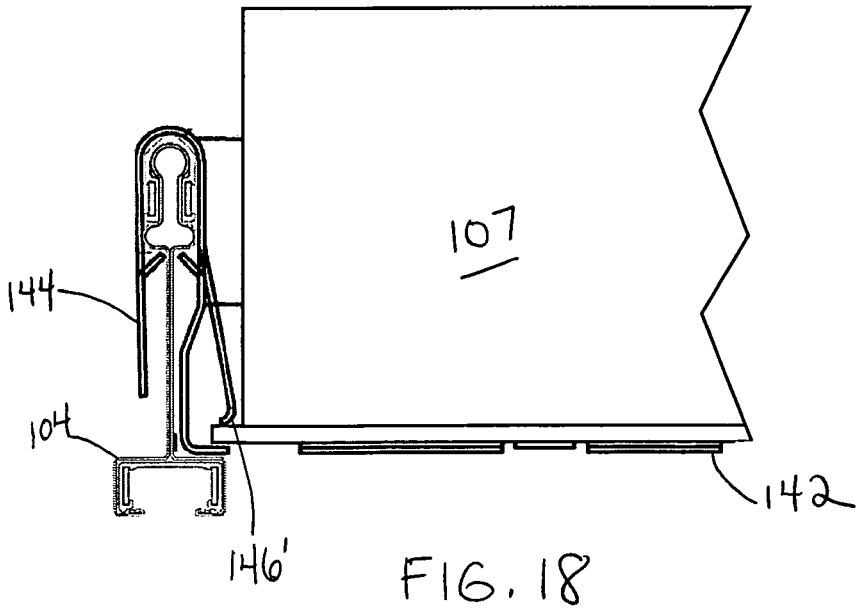
FIG. 18

GRID FRAMEWORK ACCESSORIES

CROSS REFERENCE TO RELATED APPLICATION

This application claims the benefit under 35 U.S.C. §119 (e) of U.S. provisional application Ser. No. 61/139,252, filed Dec. 19, 2008, entitled "Electrically Active Grid Framework Accessories."

BACKGROUND OF THE INVENTION

The present invention is directed to accessories which are attached to the support grid members of a grid framework system. More particularly, the accessories relate to: a means to insulate electrified conductors attached to the support grid members from other conductive items located proximate thereto; a management device for cables and wires; and a retention device for fixedly attaching a component to the grid framework system.

Today's interior building environment is dominated by fixed lighting and a wide variety of electrical devices that are typically wired for a building's lifetime rather than occupants' changing needs. Building designers and owners increasingly have been seeking systems to make their buildings more adaptable and to integrate infrastructure, equipment and furnishings therein that can improve energy efficiency and occupant comfort and productivity. Generally speaking, the increasing use of safe, low-voltage direct-current (DC) power in interior control and peripheral devices, such as lighting and other solid-state and digital equipment, is a shift aimed at increasing energy efficiency. U.S. Patent Application Publication Nos. 2006/0272256, 2007/0103824 and 2008/0087464 are examples of recent attempts to provide unprecedented design and space flexibility along with reduced energy usage via an enabling infrastructure which uses and distributes low-voltage DC power. Briefly stated, these systems attempt to change the manner in which low-voltage direct-current (DC) power is distributed to interior controls and devices resulting in an increase in flexibility, efficiency and sustainability of the interior building environment.

As described therein, low-voltage DC power is distributed and accessible via the conductors disposed on the support grid members of a grid framework, such as one used in a conventional suspended ceiling system. A low-voltage power source is then interconnected with the infrastructure, i.e. the support grid members, via one or more connectors, which, in turn, electrifies the system and creates a conductive busway. Example connectors are shown and described in WO2009128909.

It is desired that the flow of power be uninterrupted as a connector or device is attached to the electrical busway provided via the grid framework. However, the gird support members themselves are typically made of conductive metallic material and are not necessarily controlled conductors within the system. Thus, a solution is needed to protect against unintentional interferences such as electrical shorts, electrical grounding and static discharges which may be caused by these uncontrolled conductive grid support members. Additionally, it is anticipated that many connective components used in the system may be susceptible to surface particulate contaminating influences, such as dissimilar metal or metallic oxides. Accordingly, where metallic and other potentially contaminating materials are used in the composition of the grid support members, there is a need to protect and insulate at least those portions which could introduce these contaminating influences.

Additionally, though a substantial amount of cabling and wiring has been eliminated via the integration of conductors on the support grid members, at least some cables and wires are still needed in these grid framework systems. Such cabling and wiring continues to be utilized in the space above or behind the grid framework in a generally disorganized way. Thus, the cables and wires will continue to reduce the speed in which devices that are mounted within or near the grid framework can be reconfigured. Thus, what is needed is a management device for cables and wires which advances the reconfigurability and plug-and-play capability of the system.

Furthermore, particularly in seismic applications, one or more safety wires are typically required when securing a fixture component, such as a lighting device, in the grid framework. These safety wires can also interfere or otherwise reduce the ease of installation and removal of such fixture components. Thus, what is needed is a solution which eliminates or otherwise minimizes the use of these safety wires and, in turn, furthers enhances the reconfigurability and plug-and-play capability of the system.

SUMMARY OF THE INVENTION

The invention is a grid framework having at least one conductive support grid member in which its conductivity is uncontrolled. A conductive material having controllable conductivity is disposed thereon. A non-conductive insulative layer is applied to a top portion of the conductive support grid member such that the non-conductive insulative layer interposes the top portion of the support member and the conductive material. The grid framework further includes an insulative cap made of non-conductive material which straddles the non-conductive insulative layer and overlies the conductive material such that the cap and the non-conductive insulative layer sandwich the first and second conductors. The grid framework system further includes a plurality of cables and a selectively locatable management device for said cables. The grid framework system further includes a component retention device having a first portion attached to the first of the intersecting support members and a second portion attached to the second of the intersecting support members, wherein each of the first and second portions straddle the intersecting support grid members.

BRIEF DESCRIPTION OF THE DRAWINGS

FIG. 17 is a top view which illustrates the component retention device of FIG. 14 having a lighting device attached thereto.

FIG. 18 is a side elevation view illustrating the component retention clip being attached to both the support member of FIG. 2 and a lighting device.

The same reference numbers will be used throughout the drawings to refer to the same or like parts.

DETAILED DESCRIPTION OF THE INVENTION

Figure 1:
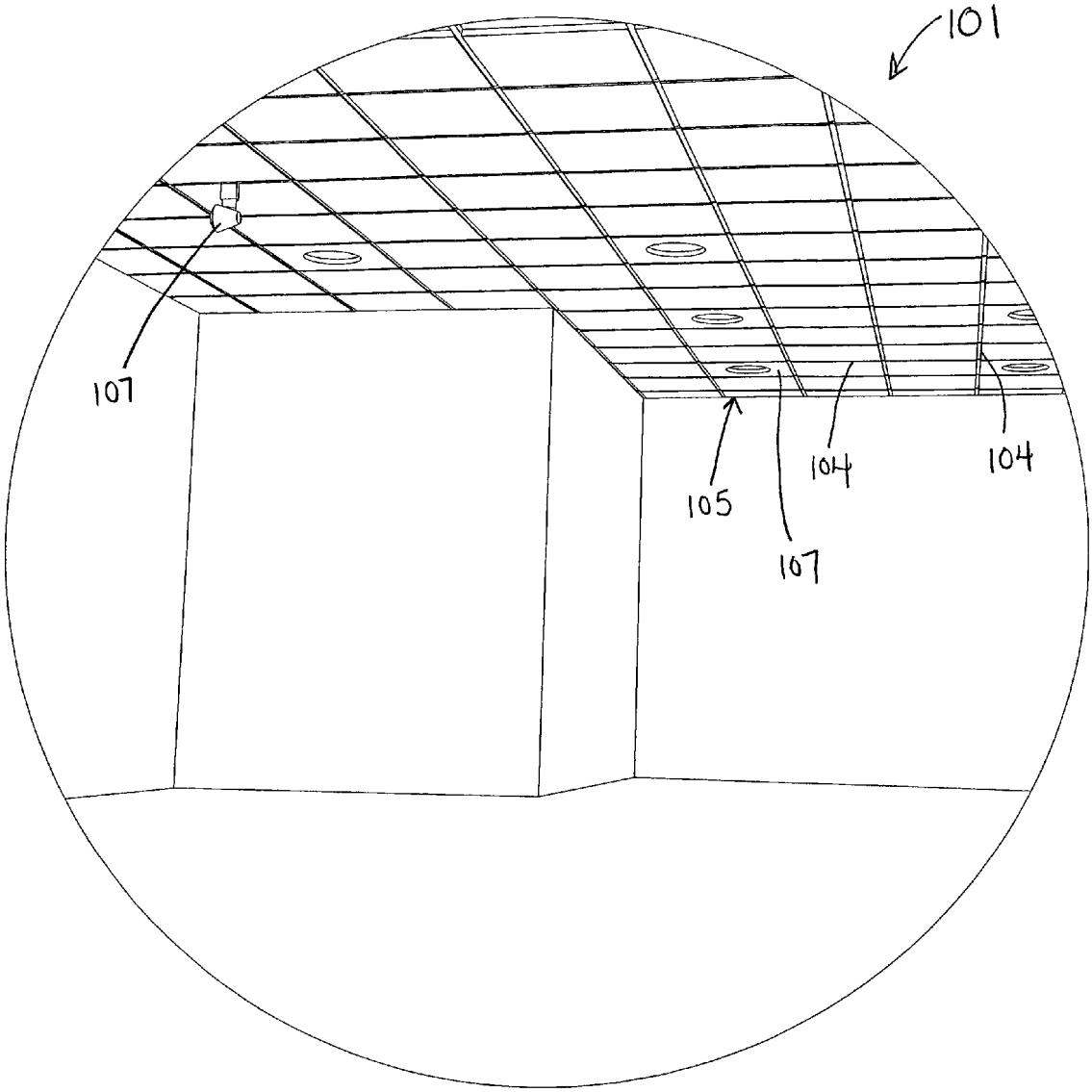
FIG. 1 is a perspective view of a room space having a grid framework system according to an embodiment of the present invention.

The present invention is directed to accessories for use in a grid framework system and particularly, to accessories useful in an electrified grid framework system where plug and play capability is available. For illustrative purposes, FIG. 1 shows an interior room space 101 having a ceiling system comprising a plurality of support grid members 104 forming a grid framework 105. Though the grid framework 105 is shown as part of a ceiling system, any system utilizing a grid framework, including floors and walls, can utilize the technology of the invention. These ceiling systems typically include components such as decorative tiles, acoustical tiles, insulative tiles, lights, heating ventilation and air conditioning (HVAC) vents, and other similar equipment which are positioned in or relative to the grid openings defined by the support grid members 104. Low-voltage electrification can be provided via a low-voltage power source (not shown) which interconnects with a pair of conductors 106 and 106' (FIG. 2) positioned on, or in, one or more support members 104 of the grid framework 105 to provide an active electrical busway. As a result of electrification, low-voltage powered devices, such as lights 107, can be easily mounted in, on or about or subsequently relocated in, on or about the ceiling system.

Insulative Layer and Cap

Figure 2:
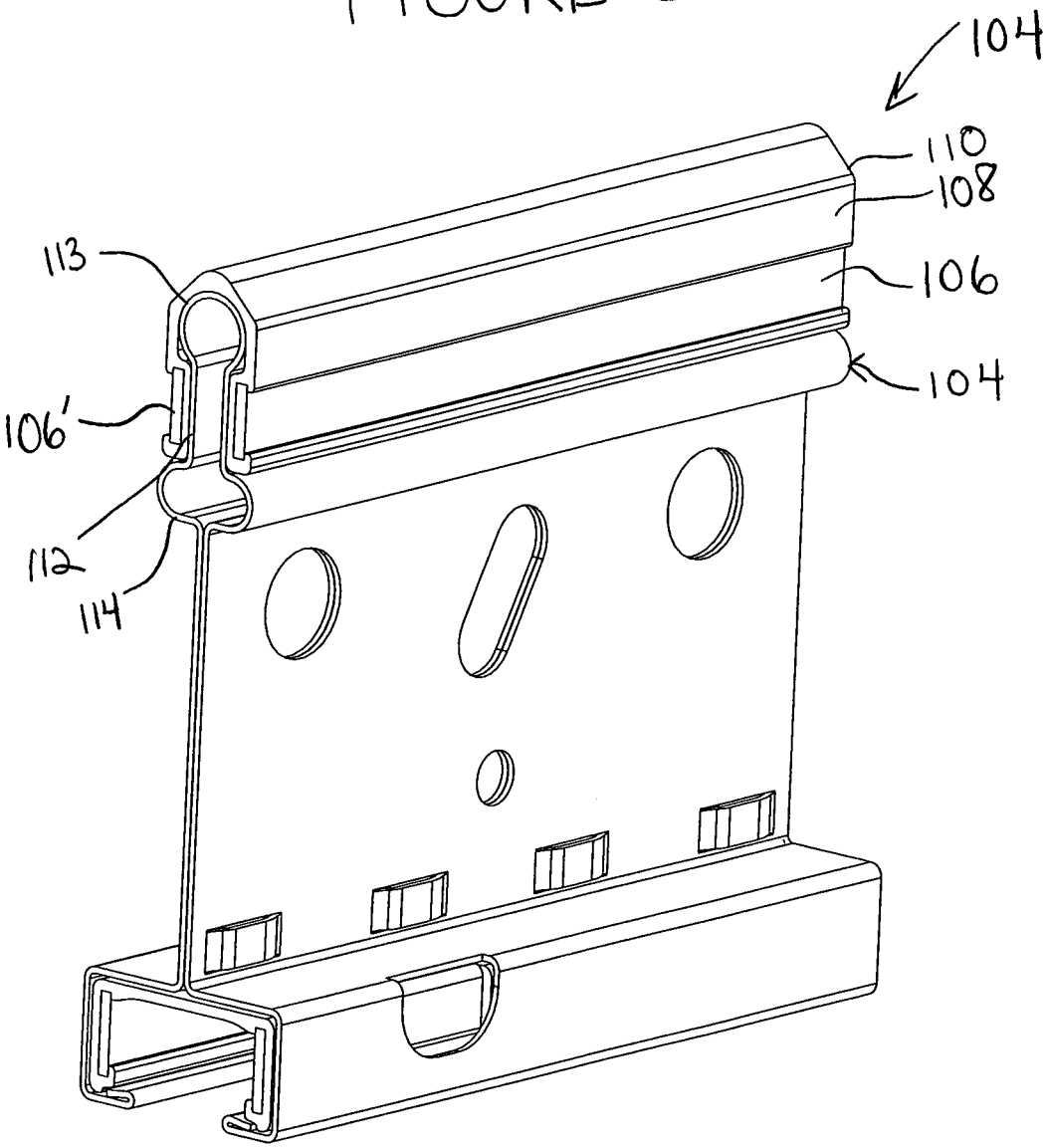
FIG. 2 is a perspective view of a support member of the grid framework system having an example non-conductive insulative member attached thereto.

As illustrated in FIG. 2, a support grid member of the invention 104 includes the improvement of an insulative layer 108 which consists of non-conductive material, and, in turn, is capable of insulating the conductors 106 and 106' from the support members 104. Such non-conductive insulative layer can be any material that is coated on, applied to, or is otherwise made a part of the support member. In the example embodiment shown, the insulative layer is an extrusion which straddles, and preferably conforms to the shape of the top portion 110 of the support member 104 to maintain as tight a profile as possible. By maintaining a tight profile, components such as lights 107 can easily be installed in, and removed from, the grid openings without physical interference from the insulative layer 108.

Additionally, by forming the insulative layer 108 over the top portion 110, it provides an insulative means during mating of an electrical connector to the top portion of the support member 104. Thus, the insulative layer 108 will protect against electrical shorts, electrical grounding and static discharges which may be caused by metal on metal contact between a support member and, for example, the metal contacts of a connector.

Additionally, the insulative layer 108 is desirably made of a material which does not impart contaminants and, thus, prevents the contamination of other materials. For example, if not for the insulative layer, the metal contact of a connector being attached to a support member could be contaminated with oxide dust or other contaminating material from the support member which may have accrued over time.

The non-conductive insulative layer 108 can be formed via extrusion methods but may be formed via any suitable formation method. One preferred extrusion method is co-extrusion bonding where the insulative layer 108 is attached to the top portion of a support member 104 during formation of the support member, such as during a conventional T-bar roll forming process. It should be noted that non-conductive materials, such as plastic, do not easily adhere to metal and thus, a bonding agent, such as an interposing elastomeric layer, may be needed to create the required bonding potential between the metal and plastic. Alternatively, the non-conductive insulative layer can be attached to a support member by mechanical engagement such as folding, snapping or sliding over the top portion of the support member. Regardless of the attachment method, it is required that the insulative member not become inadvertently dislodged subsequent to attachment to the support member.

As shown, attached to the insulative layer 108 are first and second conductors 106 and 106' of opposing polarity. The conductors 106 and 106', shown here as flat rectilinear shaped conductive wire strips, are positioned on opposing sides of the top portion 110 of the grid member with their exposed surfaces facing away from one another. This configuration is preferable as positioning the exposed surfaces adjacent one another makes the conductors more vulnerable to shorting by components, such as metal clips and wiring and other similar objects, commonly located in the space above or behind the framework. The first and second conductive wire strips preferably extend along the majority of the length of the support member so as to provide a continuous conductive busway for electricity with an otherwise unlimited number of connection points.

In the example embodiment shown, the top portion 110 of the support member 104 has a generally I-beam-shape. More specifically, the top portion has a narrow central 112 portion interposing top 113 and bottom portions 114 which are wider than the central portion. As shown, the portions of the insulative layer containing the conductors are preferably aligned with this narrow central portion such that at least some of the width of the flat wire conductors can interpose vertically the top and bottom portions, 113 and 114 respectively, to maintain a tight top portion profile.

Figure 3:
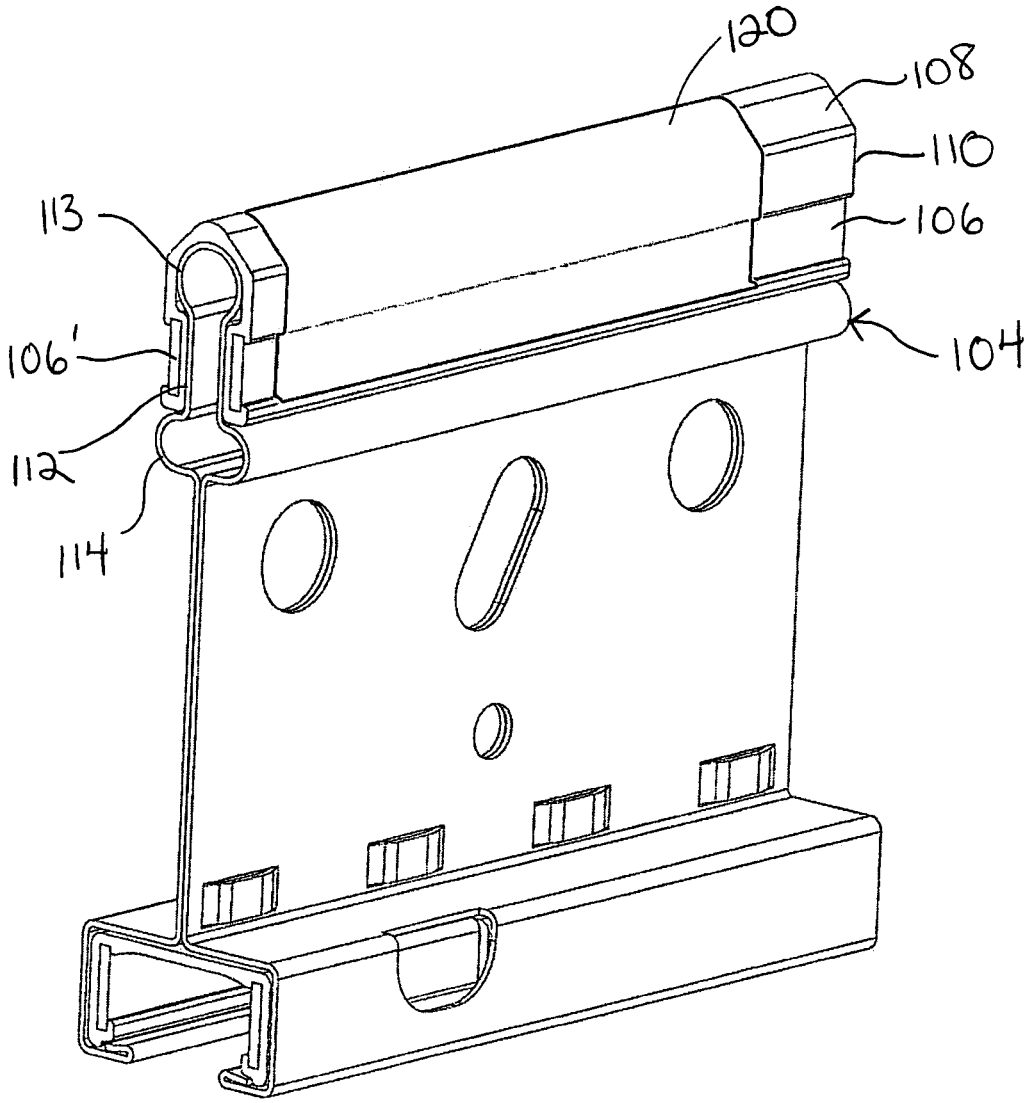
FIG. 3 is a perspective view showing an insulative cap attached to the support member and insulative member of FIG. 2.
Figure 4:
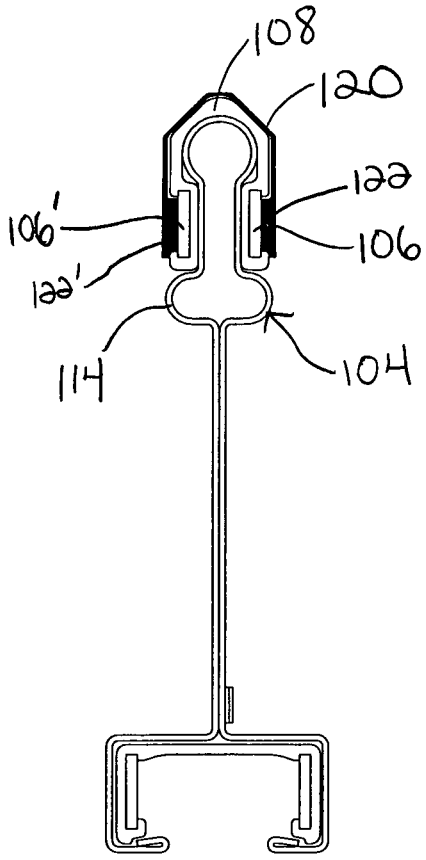
FIG. 4 is a front elevation view of FIG. 3.
Figure 6:
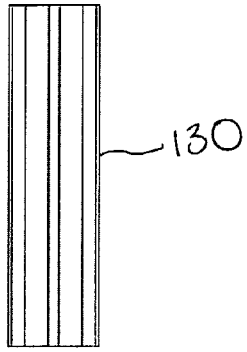
FIG. 6 is a top view of FIG. 5.
Figure 5:
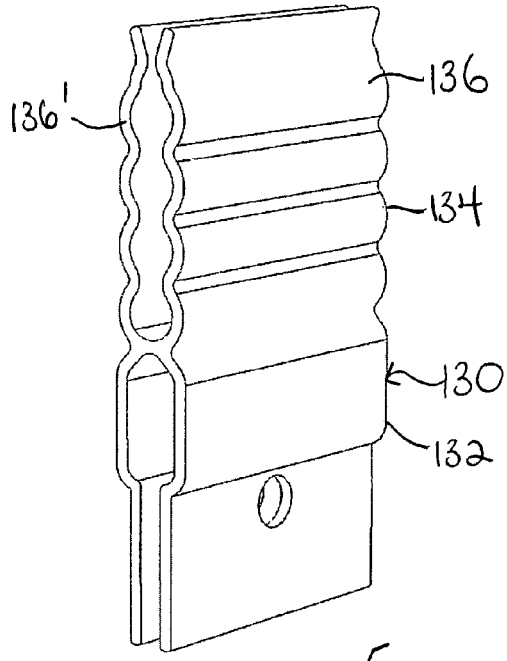
FIG. 5 is a perspective view of an example management device for cables and wires.
Figure 7:
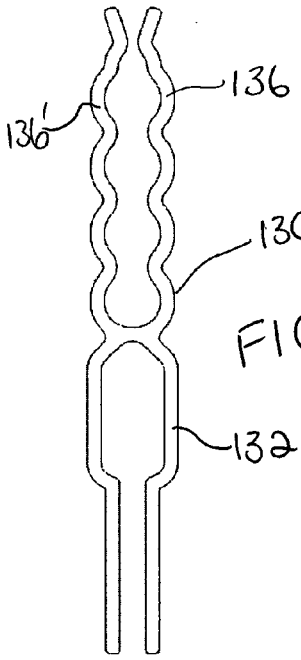
FIG. 7 is a front view of FIG. 5.
Figure 8:
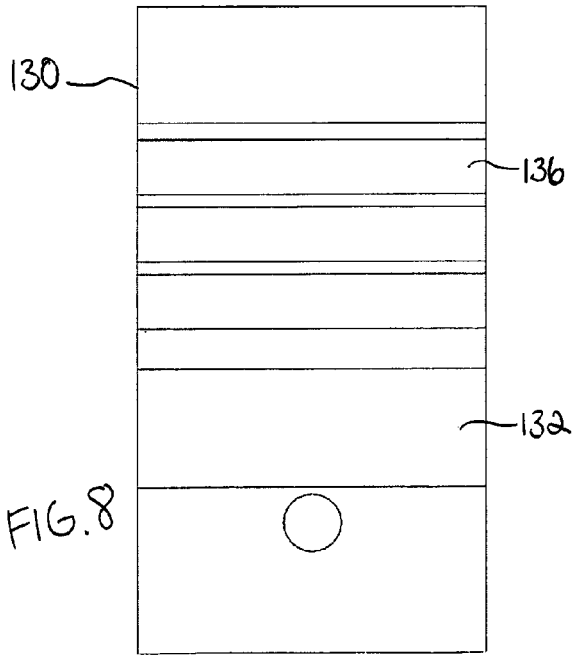
FIG. 8 is a side view of FIG. 5.
Figure 9:
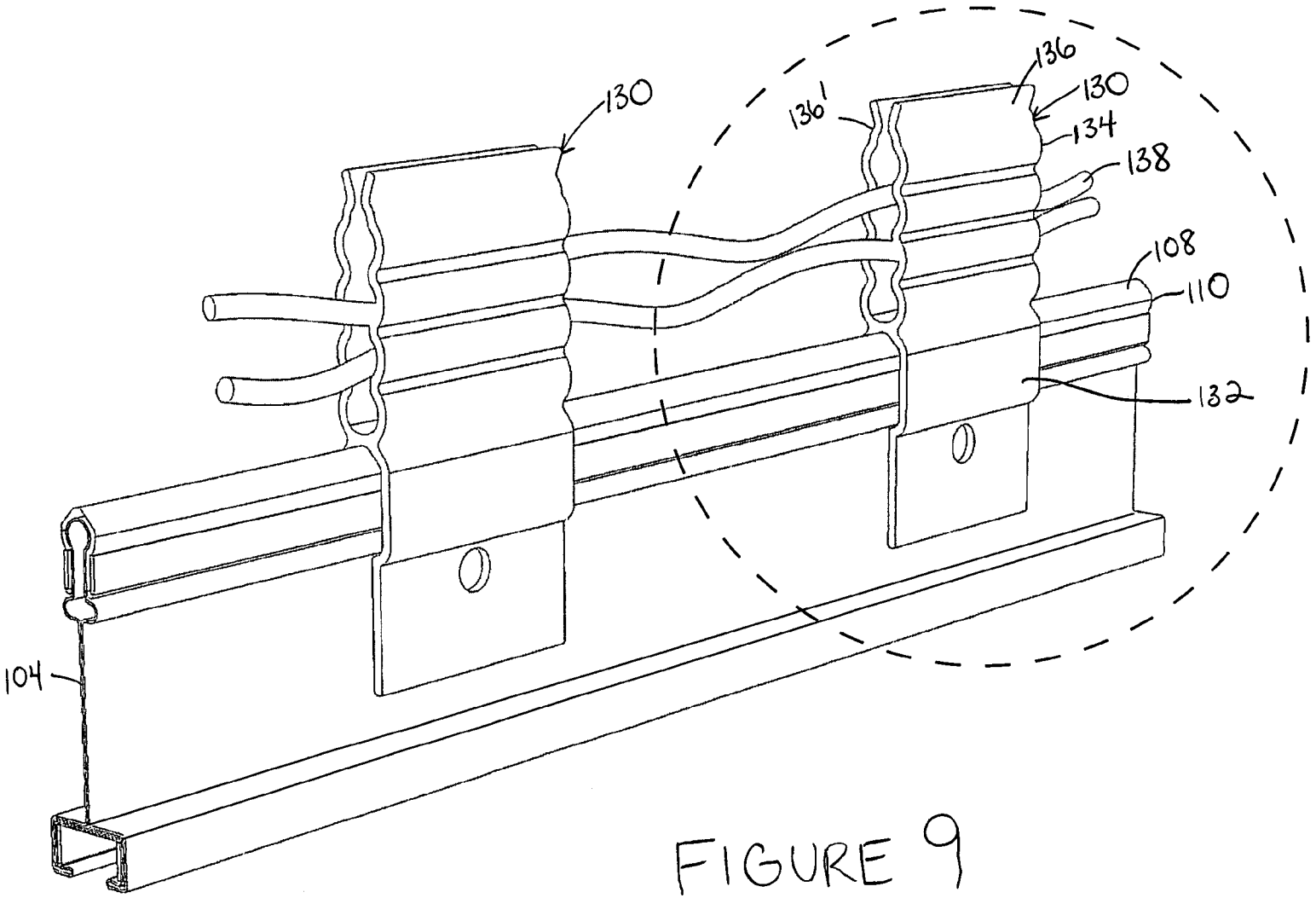
FIG. 9 is a perspective view of two example management devices of FIGS. 5-8 attached to the support member shown in FIG. 2.
Figure 10:
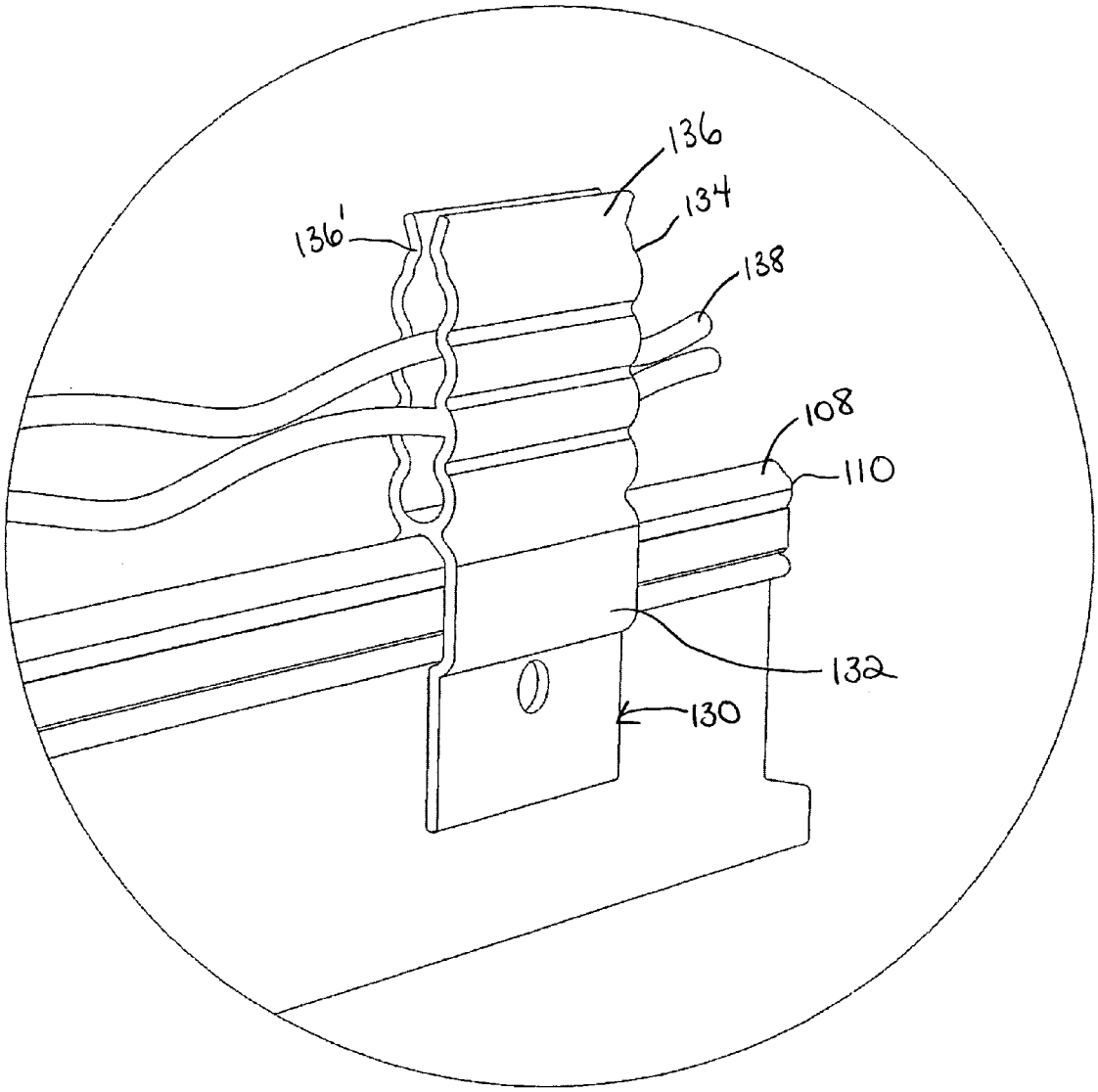
FIG. 10 is close-up perspective view of a portion of FIG. 9.

For those support members 104 which merely carry the electrical load from one support to another, the exposed surfaces of the electrified conductors 106 and 106' can be insulated, thereby ensuring they do not come into inadvertent contact with other conductive components (e.g. metal clips, wires, etc.) which can short out the bus, the electrical connection to the bus or trip a circuit fault device resulting in an interruption of the flow of electricity to the bus. As shown in FIGS. 3 and 4, an example insulative cap 120 made of non-conductive material is used to cover all or a portion of the conductors 106 and 106' disposed on the top portion 110 of a support member 104. In the example embodiment shown, the insulative cap 120 straddles, and covers the conductors 106 and 106'.

In the example shown, the insulative cap 120 conforms to the shape of, the non-conductive insulative 108 member so that a tight profile for the top portion 110 of the support member 104 is maintained. It is preferred that such cap 120 be formed in tension so that it does not become inadvertently dislodged from the support member 104 once it is attached.

Further, such cap may be made of resilient material such that it can be attached to the support member by snapping it over the non-conductive insulative member and then unattached and later reused. As can be seen, the profile of the fully installed non-conductive insulative member and cap preferably does not extend beyond the widest portion of the bulb so that a tight a profile is maintained. For example, as best seen in FIG. 4, the outer surface of the cap 120 is in substantial vertical alignment with the most outwardly extending surface of the bottom potion 114 of the I-shaped top portion of the support member.

The insulative cap 120 can optionally include first and second protrusions, 122 and 122' such that when the cap straddles over top of the top portion 110 of the support member, the protrusions extend in a direction toward one another. These protrusions can be seated, at least partially, in a respective conductor receiving recess for better mechanical attachment. This tongue and groove-type configuration better envelopes and, in turn, better insulates the conductors.

Wire Management Device

Another accessory which can be utilized on both an electrified and non-electrified framework system 105 is a selectively locatable management device for cables and wires. The management device eliminates the need for conventional raceways, cable trays and wiring baskets. As illustrated in FIGS. 5-10, an example management device 130 includes a first portion 132 which attaches to the top portion 110 of a support grid member 104. Similar to the insulative member and insulative cap described above, the first portion of the management device 130 straddles, and preferably contours to the shape of, the top portion of the grid support member to maintain a tight profile. The first portion of the management device 130 can be mounted over the insulative layer 108 solely or over both the insulative layer 108 and insulative cap 120. The management device 130 is preferably made of non-conductive resilient material such that the first portion of the clip can be snapped over the top portion 110 of the support member, or conversely, removed and then re-installed.

The management device 130 includes a second portion 134 having two substantially vertically extending legs 136, 136' which provide for the management and retention of cables and wires 138 (FIG. 10) therebetween and within. The legs 136, 136' of the second portion 134 are integrally connected to the first portion 132 and are preferably positioned vertically above the first portion 132. Most preferably, the legs 136, 136' are positioned directly above and within the width of the first portion so as to provide the advantage of keeping the wires and cables disposed therebetween and within in vertical alignment with the grid support members of the grid framework. In turn, the wires will essentially conform to the path of the grid members. Due to the predictable regularity of this routing, this further provides the advantage that wires and cables can be pre-manufactured to length or, at the very least, cut to precise length in the field. As the amount of wire needed can be measured more precisely, less wire will be wasted (i.e. no unnecessary wire slack) which can result in significant cost savings. Also, the wires and cables will not obstruct the clearances/openings into which components, such as lights, are mounted into the grid framework.

Component Retention Device

As mentioned previously, one or more safety wires are commonly required to secure a fixture, such as the light 107 shown in FIG. 1, in the grid framework. Particularly, in an electrified framework system where reconfigurable plug and play capability is available, the safety wires get in the way or other wise make more difficult the installing and removing these components. The example component retention device 140 shown in FIGS. 14-18 is a substitution for these safety wires. This component retention device 140 is preferably comprised of spring metal and has a first portion 142 and a second portion 144 which are integrally connected. In the example embodiment shown, the first portion 142 is positioned perpendicularly to the second portion 144 so that the device 140 can be attached to two adjacent intersecting support members 104. As shown, each of the first and second portions can straddle intersecting support grid members. One or both of the first and second portions must be fixedly attached to the support members either using a mechanical interference means or a mechanical fastener such as a rivet or screw.

Each of the first and second portions, 142 and 144 respectively, includes a resilient spring element 146, 146' which is integrally formed, e.g. stamped, in each of the first and second portions. The resilient spring element retains a component, such as a light 107, and, in effect, fixedly attaches the component to the grid framework. This resilient spring element is configured to allow a component, such as a light 107, to be placed in, and retained in, a grid opening but not removed unless an intentional release means or tool release is used. A major advantage of this device is that fixtures can be installed and then uninstalled without having to remove the retention device from the grid framework. Additionally, the retention device 140 reinforces the connection of the grid support members to one another and at the same time provides rigidity/strength to the grid framework.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

For example, the insulator cap 120 may simply be a coating or film which is applied over the conductors. The coating or film must be made of material which, like the cap described above, can be selectively removed, such as by cutting, peeling or scrapping (e.g. using an insulation displacing device), thereby displacing the coating or film and making the underlying conductors available for electrical connection.

Figure 11:
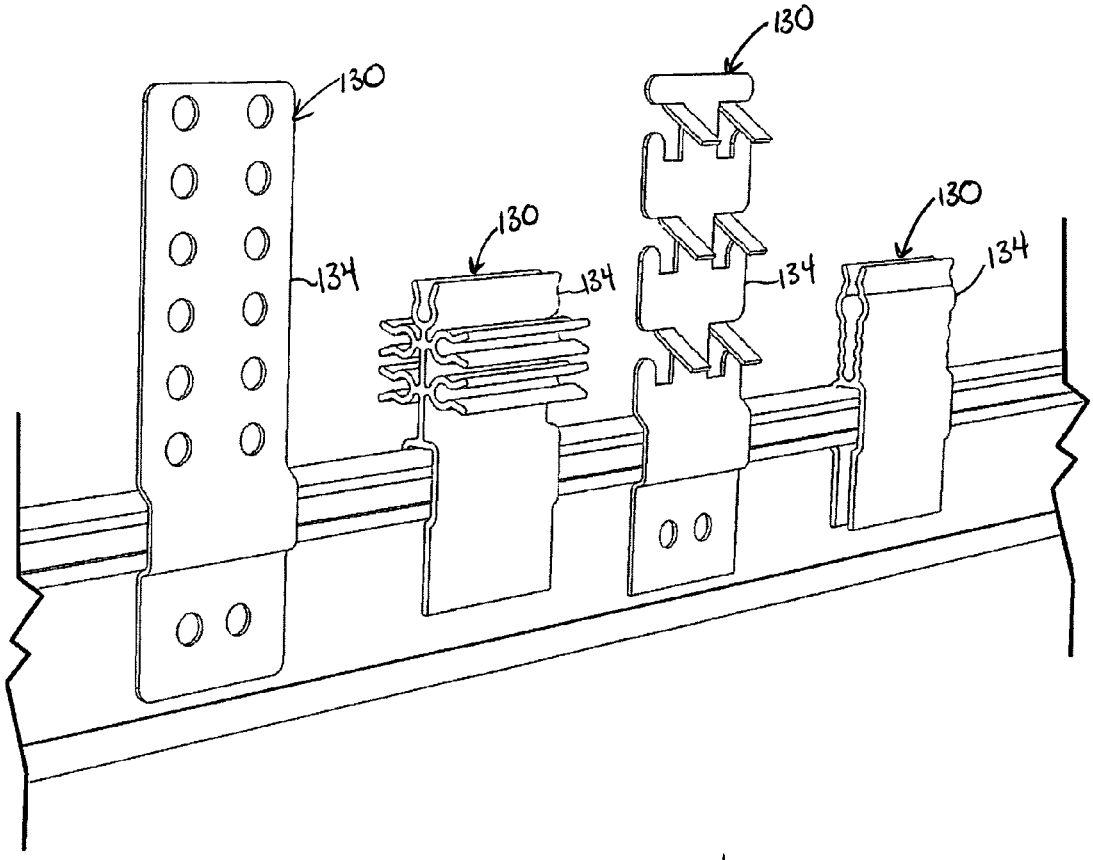
FIG. 11 is a perspective view illustrating several alternative example management devices.
Figure 12:
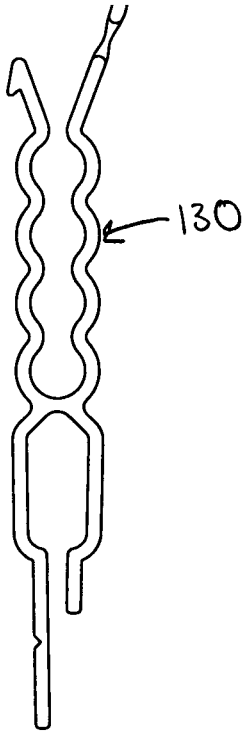
FIGS. 12 and 13 are front views of the example management device of FIGS. 5-9 illustrating an optional clasp.
Figure 13:
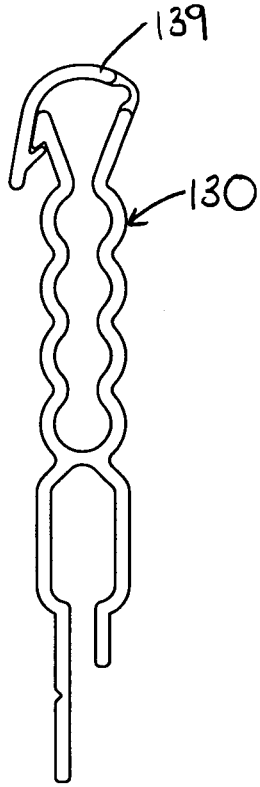
Figure 14:
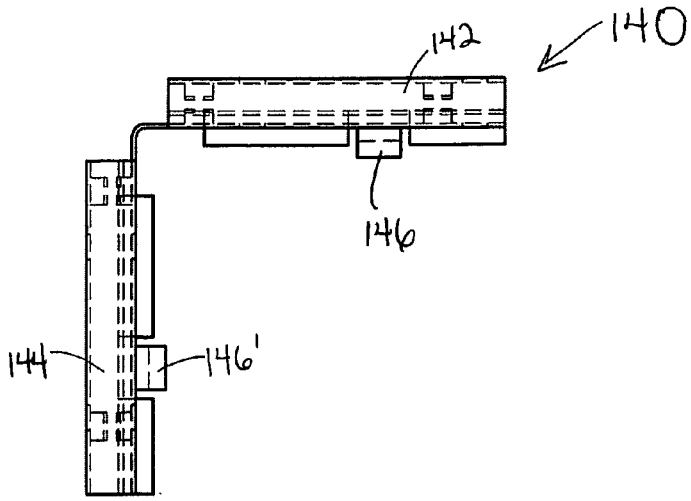
FIG. 14 is a top of an example component retention device.
Figure 15:
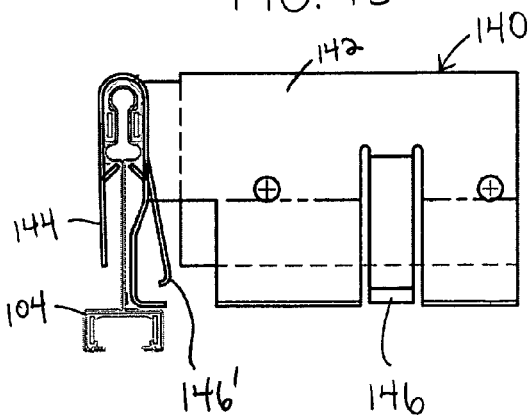
FIGS. 15 and 16 are side elevation views of an example component retention device attached to the support member of FIG. 2.
Figure 16:
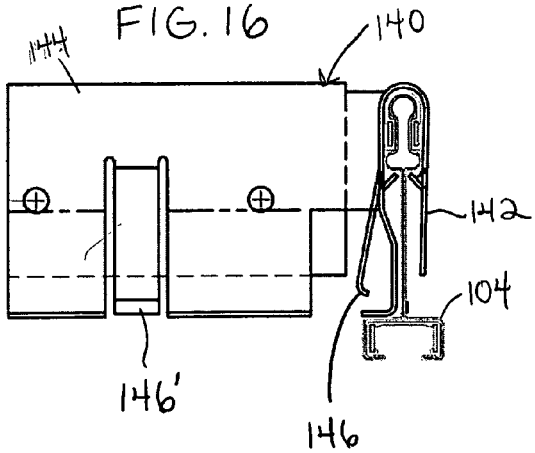

Also, FIG. 11 illustrates several example configurations of the second portion 134 of the management device 130, all of which are capable of managing and retaining wiring and cabling. Also, FIGS. 12 and 13 illustrate an optional clasp 139 for locking wiring and bracing in the second portion of the management device.

We claim:

1. A grid framework system comprising:

first and second intersecting support grid members forming grid openings for insertion of components;

a component retention device having a first portion attached to the first intersecting support grid member and a second portion attached to the second intersecting support grid member, wherein each of the first and second portions comprises an upper end terminating in a bight portion that straddles a respective one of the first and second intersecting support grid members;

a resilient spring element integrally formed with and connected to each of the first and second portions;

a component support flange integrally formed with and connected to a lower end of each of the first and second portions, wherein the component support flanges of the first and second portions are located in the same horizontal plane;

wherein each of the resilient spring elements is pivotably movable relative to a respective one of the first and second portions in response to inserting a component into the component retention device;

wherein each of the resilient spring elements is connected to a respective one of the first and second portions at a location between the bight portion and the component support flange; and wherein the bight portions of the first and second portions are located in the same horizontal plane.

2. The grid framework system of claim 1, wherein the resilient spring elements are configured to allow the component to be placed in and retained in one of the grid openings but not removed therefrom unless the resilient spring elements are pivotably moved with a release tool to release the component.

3. The grid framework system of claim 2, wherein the component can be installed and then uninstalled without having to remove the component retention device from the grid framework.

4. The grid framework system of claim 3, wherein the component retention device reinforces connection of the grid support members to one another and provides rigidity and strength to the grid framework.

5. The grid framework system of claim 1, wherein each of the resilient spring elements is connected to the respective one of the first and second portions of the component retention device at a location above a vertical midpoint of the respective one of the first and second portions.

6. The grid framework system of claim 1, wherein each of the resilient spring elements is pivotably movable in a horizontal direction about a location where each of the resilient spring elements is connected to the respective one of the first and second portions of the component retention device.

7. The grid framework system of claim 1, wherein each of the resilient spring elements has an end pivotably connected to the respective one of the first and second portions of the component retention device and an opposite free end arranged to engage the component.

8. The grid framework system of claim 7, wherein the free end of each of the resilient spring elements includes an inwardly turned portion.

9. The grid framework system of claim 1, wherein each of the resilient spring elements makes linear contact with the component when inserted into the component retention device.

10. The grid framework system of claim 1, wherein the first and second portions of the component retention device are integrally connected to and disposed perpendicular to each other.

11. The grid framework system of claim 1, wherein the first and second portions of the component retention device have a height, and each of the resilient spring elements has a length which is the same or greater than half the height of the first and second portions of the component retention device.

12. The grid framework system of claim 1, wherein the component retention device is a single component.

13. The grid framework system of claim 1, wherein the resilient spring element is stamped into each of the first and second portions respectively.

14. A grid framework system comprising:

first and second support grid members arranged in intersecting relationship and forming grid openings for insertion of components, the first and second support grid members each having a top portion;

a component retention device having a first portion with a length and a height and a second portion with a length and a height oriented perpendicular to the first portion, the first and second portions being connected to each other, each of the first and the second portion comprising a bight portion;

the first portion being attached to the first support grid member so that the bight portion of the first portion straddles the first support grid member, and the second portion being attached to the second support grid member so that the bight portion of the second portions straddles the second support grid member;

a resilient spring element integrally formed with and connected to each of the first and second portions;

a component support flange integrally formed with and connected to each of the first and second portions at a connection location proximate to a bottom portion of the respective one of the first and second portions of the component retention device, wherein the component support flanges of the first and second portions are located in the same horizontal plane; and wherein the bight portions of the first and second portions are located in the same horizontal plane.

15. The grid framework system of claim 14, wherein each of the resilient spring elements includes an inwardly turned end portion opposite a portion of the resilient spring element that is connected to a respective one of the first and second portions of the component retention device.

16. The grid framework system of claim 14, wherein the first and second portions of the component retention device are formed of spring steel.

17. The grid framework system of claim 14, wherein each of the resilient spring elements has a length which is the same or greater than half the height of the first and second portions of the component retention device.

18. The grid framework system of claim 14, wherein each of the resilient spring elements makes linear contact with a component inserted into the component retention device.

19. A grid framework system comprising:

first and second support grid members arranged in an intersecting relationship and forming a plurality of grid openings for insertion of components, the first and second support grid members each having a top portion;

a component retention device having a first portion and a second portion oriented perpendicular to the first portion, the first and second portions being connected to each other, each of the first and the second portions having a bight portion;

the first portion being attached to the first support grid member so that the bight portion of the first portion straddles the first support grid member and the second portion being attached to the second support grid member so that the bight portion of the second portion straddles the second support grid member;

a first resilient spring element integrally formed with and connected to the first portion at a location below the bight portion of the first portion;

a first component support flange connected to the first portion below the first resilient spring element;

a second resilient spring element integrally formed with and connected to the second portion at a location below the bight portion of the second portion;

a second component support flange connected to the second portion below the second resilient spring element.

* * * * *